US006976941B2

(12) United States Patent
Britt

(10) Patent No.: US 6,976,941 B2
(45) Date of Patent: Dec. 20, 2005

(54) RESISTIVE EXERCISE SYSTEM

(76) Inventor: Norman G. Britt, 1505 W. Suggett, Enid, OK (US) 73703

( * ) Notice: Subject to any disclaimer, the term of this patent is extended or adjusted under 35 U.S.C. 154(b) by 348 days.

(21) Appl. No.: 10/281,469

(22) Filed: Oct. 24, 2002

(65) Prior Publication Data

US 2004/0082443 A1 Apr. 29, 2004

(51) Int. Cl.[7] ..... A63B 21/06
(52) U.S. Cl. ..... 482/94; 482/95; 482/97; 482/101; 482/102
(58) Field of Search ..... 482/94–103

(56) References Cited

U.S. PATENT DOCUMENTS

| | | | | |
|---|---|---|---|---|
| 4,149,714 A | | 4/1979 | Lambert, Jr. | 272/118 |
| 4,231,568 A | | 11/1980 | Riley et al. | 272/136 |
| 4,564,193 A | * | 1/1986 | Stewart | 482/60 |
| 4,856,773 A | * | 8/1989 | Deola | 482/102 |
| 4,953,855 A | * | 9/1990 | Shields | 482/99 |
| 5,080,351 A | | 1/1992 | Rockwell | 272/134 |
| 5,080,353 A | * | 1/1992 | Tench | 482/130 |
| 5,230,680 A | * | 7/1993 | Wu | 482/97 |
| 5,236,406 A | | 8/1993 | Webber | 482/100 |
| 5,330,405 A | | 7/1994 | Habing et al. | 482/96 |
| 5,738,616 A | * | 4/1998 | Robertson | 482/102 |
| 5,839,995 A | | 11/1998 | Chen | 482/92 |
| 5,916,072 A | | 6/1999 | Webber | 482/100 |
| 6,361,479 B1 | | 3/2002 | Hildebrandt et al. | 482/72 |
| 6,394,937 B1 | * | 5/2002 | Voris | 482/139 |
| 2001/0023221 A1 | * | 9/2001 | Simonson | 482/103 |
| 2003/0027696 A1 | * | 2/2003 | Baumler et al. | 482/99 |
| 2004/0018920 A1 | * | 1/2004 | Simonson | 482/99 |
| 2004/0082444 A1 | * | 4/2004 | Golesh | 482/99 |
| 2004/0198565 A1 | * | 10/2004 | Lines et al. | 482/99 |
| 2005/0164851 A1 | * | 7/2005 | Eisa | 482/94 |

* cited by examiner

*Primary Examiner*—Gregory L. Huson
*Assistant Examiner*—L. Amerson

(57) ABSTRACT

A resistive exercise system for enabling individuals of a weakened physical condition to perform various resistive exercises. The resistive exercise system includes a frame structure, a seat member secured within the frame structure at a low entry level, a pair of opposing arm supports attached to the frame structure, a plurality of weight members adjustably positioned upon a weight shaft, and a plurality of cables attached to the weight shaft each having a handle attached thereto. A tubular support member is attached to the front of the frame structure for receiving an elongate tongue member that supports a resistance pedal structure.

2 Claims, 4 Drawing Sheets

RESISTIVE EXERCISE SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to exercise machines and more specifically it relates to a resistive exercise system for enabling individuals of a weakened physical condition to perform various resistive exercises.

2. Description of the Related Art

Exercise machines such as universal machine, benches, stationary bicycles, treadmills, stair machines and the like have been in use for years. Individuals of a weakened physical condition, such as the elderly or physically challenged, require exercise to improve their health. However, the main problem with conventional exercise machines available today is that they do not allow for individuals of a weakened physical condition to properly exercise their body. A further problem with conventional exercise machines is that they are not designed to easily receive an individual of a weakened physical condition. Another problem with conventional exercise machines is that it can be difficult, if not impossible, for an individual within a wheelchair to move from the wheelchair to the seat of the machine.

Examples of patented devices which may be related to the present invention include U.S. Pat. No. 5,080,353 to Tench; U.S. Pat. No. 6,394,937 to Voris; U.S. Pat. No. 6,361,479 to Hildebrandt et al; U.S. Pat. No. 4,149,714 to Lambert, Jr.; U.S. Pat. No. 5,916,072 to Webber; U.S. Pat. No. 5,080,351 to Rockwell; U.S. Pat. No. 5,330,405 to Habing et al.; U.S. Pat. No. 4,231,568 to Riley et al.; U.S. Pat. No. 5,236,406 to Webber; and U.S. Pat. No. 5,839,995 to Chen.

While these devices may be suitable for the particular purpose to which they address, they are not as suitable for enabling individuals of a weakened physical condition to perform various resistive exercises. Conventional exercise machines are not designed for physically weakened or physically challenged individuals.

In these respects, the resistive exercise system according to the present invention substantially departs from the conventional concepts and designs of the prior art, and in so doing provides an apparatus primarily developed for the purpose of enabling individuals of a weakened physical condition to perform various resistive exercises.

BRIEF SUMMARY OF THE INVENTION

In view of the foregoing disadvantages inherent in the known types of exercise machines now present in the prior art, the present invention provides a new resistive exercise system construction wherein the same can be utilized for enabling individuals of a weakened physical condition to perform various resistive exercises.

The general purpose of the present invention, which will be described subsequently in greater detail, is to provide a new resistive exercise system that has many of the advantages of the exercise machines mentioned heretofore and many novel features that result in a new resistive exercise system which is not anticipated, rendered obvious, suggested, or even implied by any of the prior art exercise machines, either alone or in any combination thereof.

To attain this, the present invention generally comprises a frame structure, a seat member secured within the frame structure at a low entry level, a pair of opposing arm supports attached to the frame structure, a plurality of weight members adjustably positioned upon a weight shaft, and a plurality of cables attached to the weight shaft each having a handle attached thereto. A tubular support member is attached to the front of the frame structure for receiving an elongate tongue member that supports a resistance pedal structure.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a resistive exercise system that will overcome the shortcomings of the prior art devices.

A second object is to provide a resistive exercise system for enabling individuals of a weakened physical condition to perform various resistive exercises.

Another object is to provide a resistive exercise system that may be utilized by individuals of a weakened physical condition and physically challenged individuals.

An additional object is to provide a resistive exercise system that allows for gradual strengthening of various muscle groups.

A further object is to provide a resistive exercise system that allows for the safe transfer of an individual from a wheelchair to the machine.

Another object is to provide a resistive exercise system that allows for convenient operation and control of the entire machine from the seat of the exercise device.

A further object is to provide a resistive exercise system that is capable of receiving individuals of various weights and sizes.

Another object is to provide a resistive exercise system that is compact in size.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
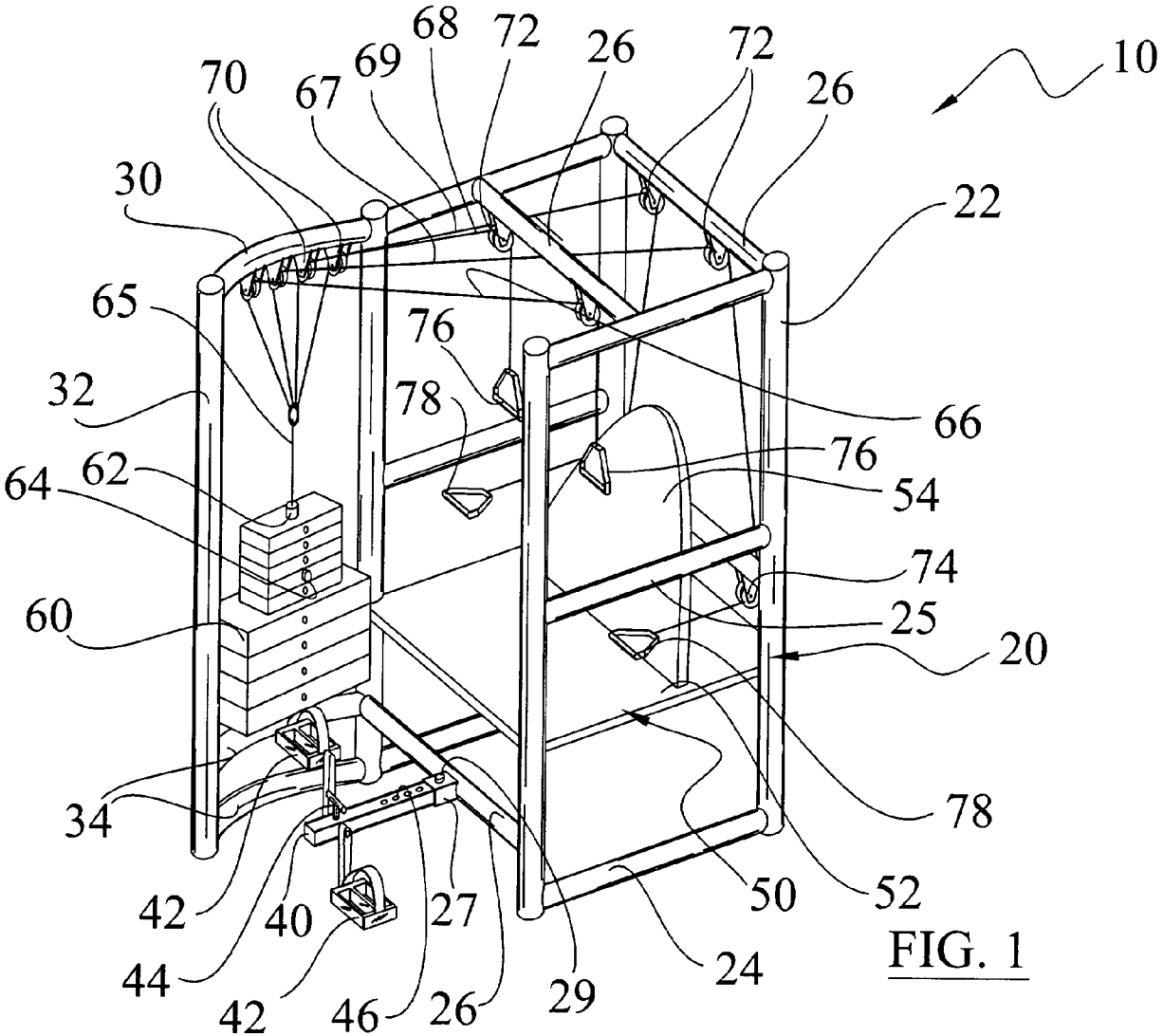
FIG. 1 is an upper perspective view of the present invention.

Turning now descriptively to the drawings, in which similar reference characters denote similar elements throughout the several views, FIGS. 1 through 4 illustrate a resistive exercise system 10, which comprises a frame structure 20, a seat member 50 secured within the frame structure 20 at a low entry level, a pair of opposing arm supports 25 attached to the frame structure 20, a plurality of weight members 60 adjustably positioned upon a weight shaft 62, and a plurality of cables 66, 67, 68, 69 attached to the weight shaft 62 each having a handle attached thereto. A tubular support member 27 is attached to the front of the frame structure 20 for receiving an elongate tongue member 40 that supports a resistance pedal structure.

FIGS. 1 through 4 illustrate the frame structure 20. The frame structure 20 is preferably comprised of a relatively compact structure with a small floor footprint. The frame structure 20 may be comprised of various structural materials such as but not limited to aluminum, steel and the like.

Figure 2:
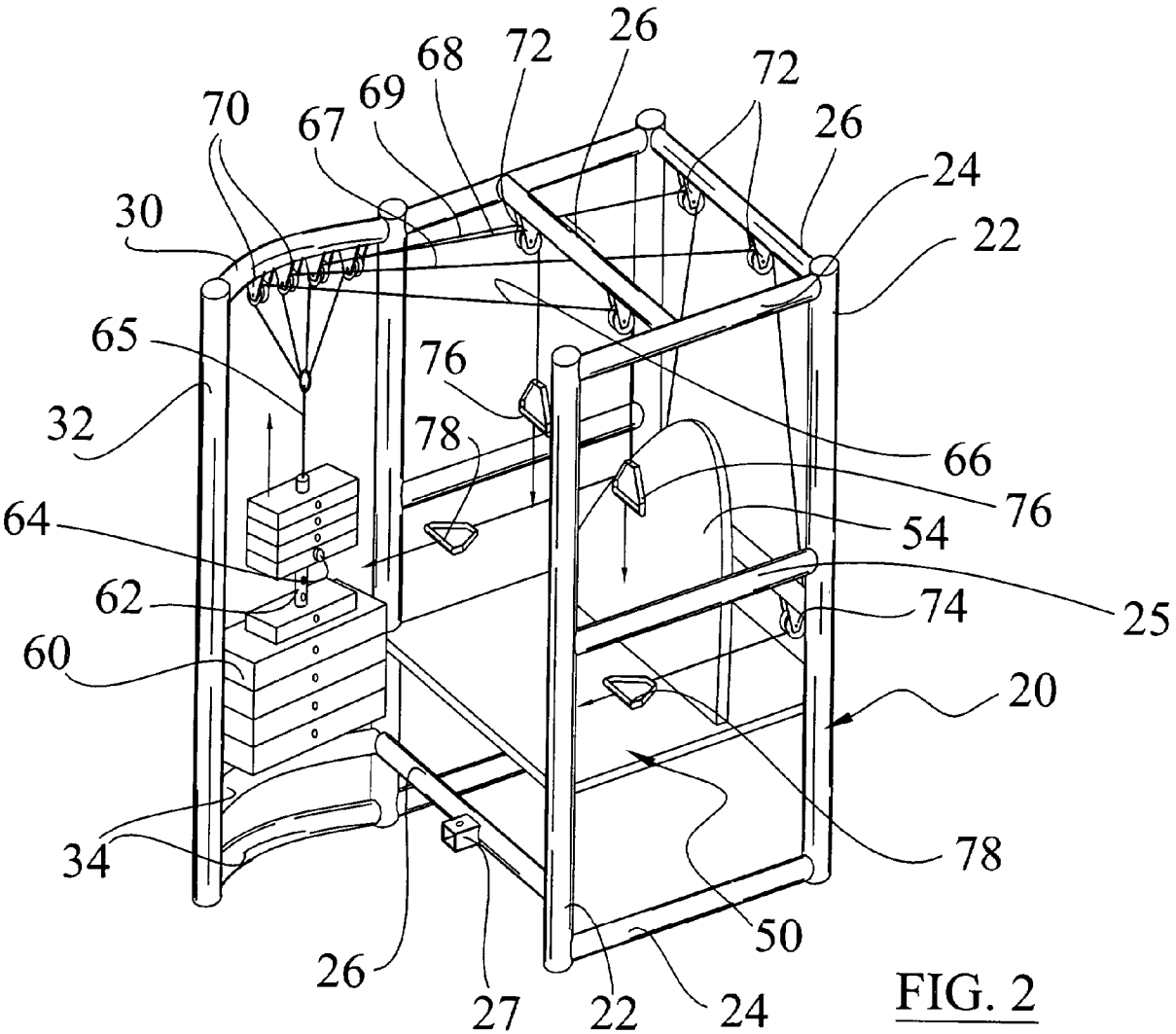
FIG. 2 is an upper perspective view of the present invention illustrating the lifting of the weights.
Figure 4:
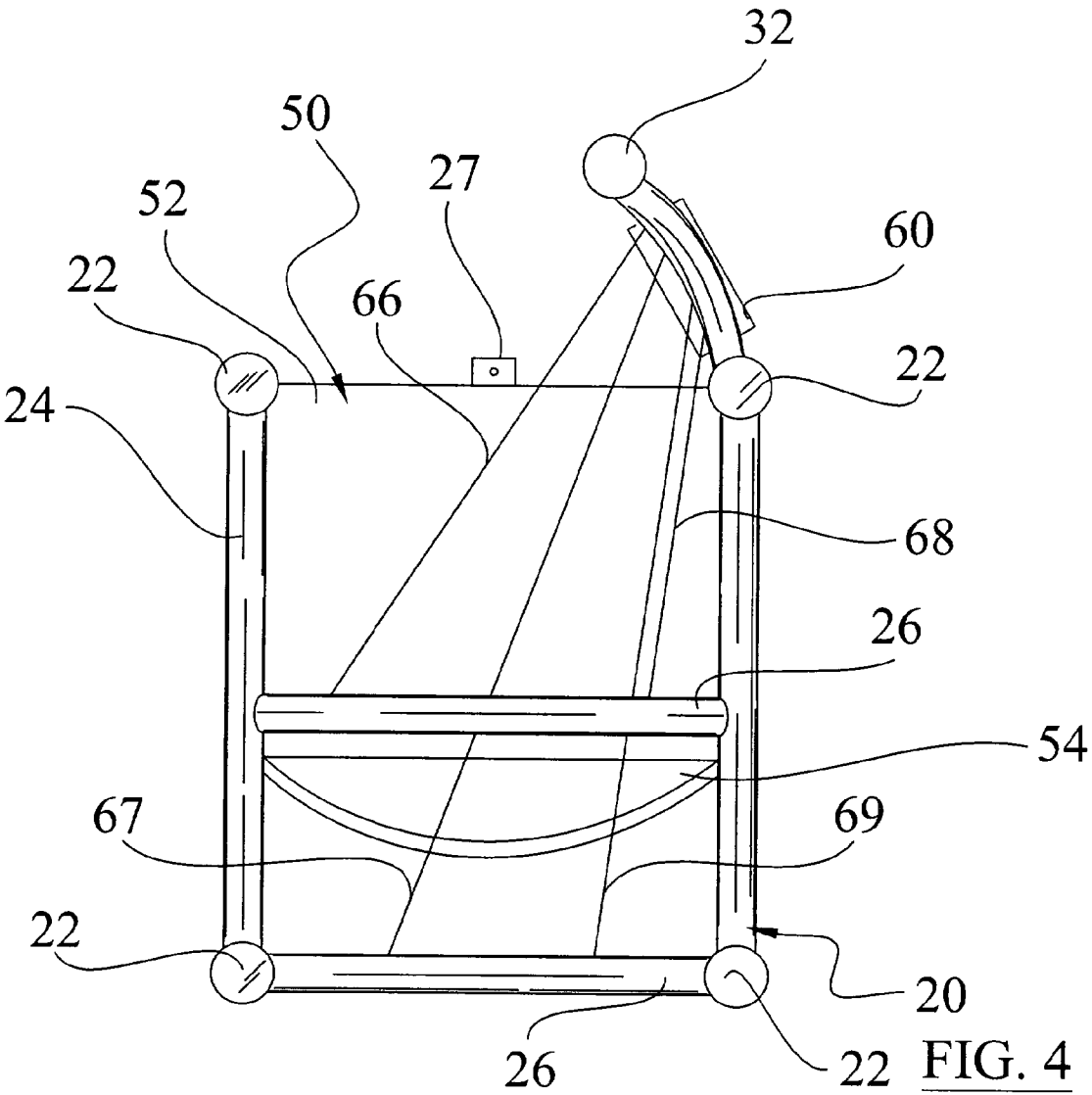
FIG. 4 is a top view of the present invention.

FIGS. 1 and 2 best illustrate the overall structure of the frame structure 20. The frame structure 20 preferably includes four main vertical members 22 extending in a vertical manner parallel to one another. The main vertical members 22 preferably form a square or rectangular structure as shown in FIG. 4 of the drawings.

A plurality of first cross members 24 and a plurality of second cross members 26 extend between and connect each of the main vertical members 22. The first cross members 24 extend between opposing main vertical members 22 as best shown in FIG. 2 of the drawings. The second cross members 26 extend between opposing main vertical members 22 transverse with respect to the first cross members 24. The cross members 24, 26 preferably are positioned within both lower and upper segments of the frame structure 20 for providing additional support to the frame structure 20. It can be appreciated that different structures may be utilized to construct the frame structure 20 other than illustrated in the figures.

Figure 3:
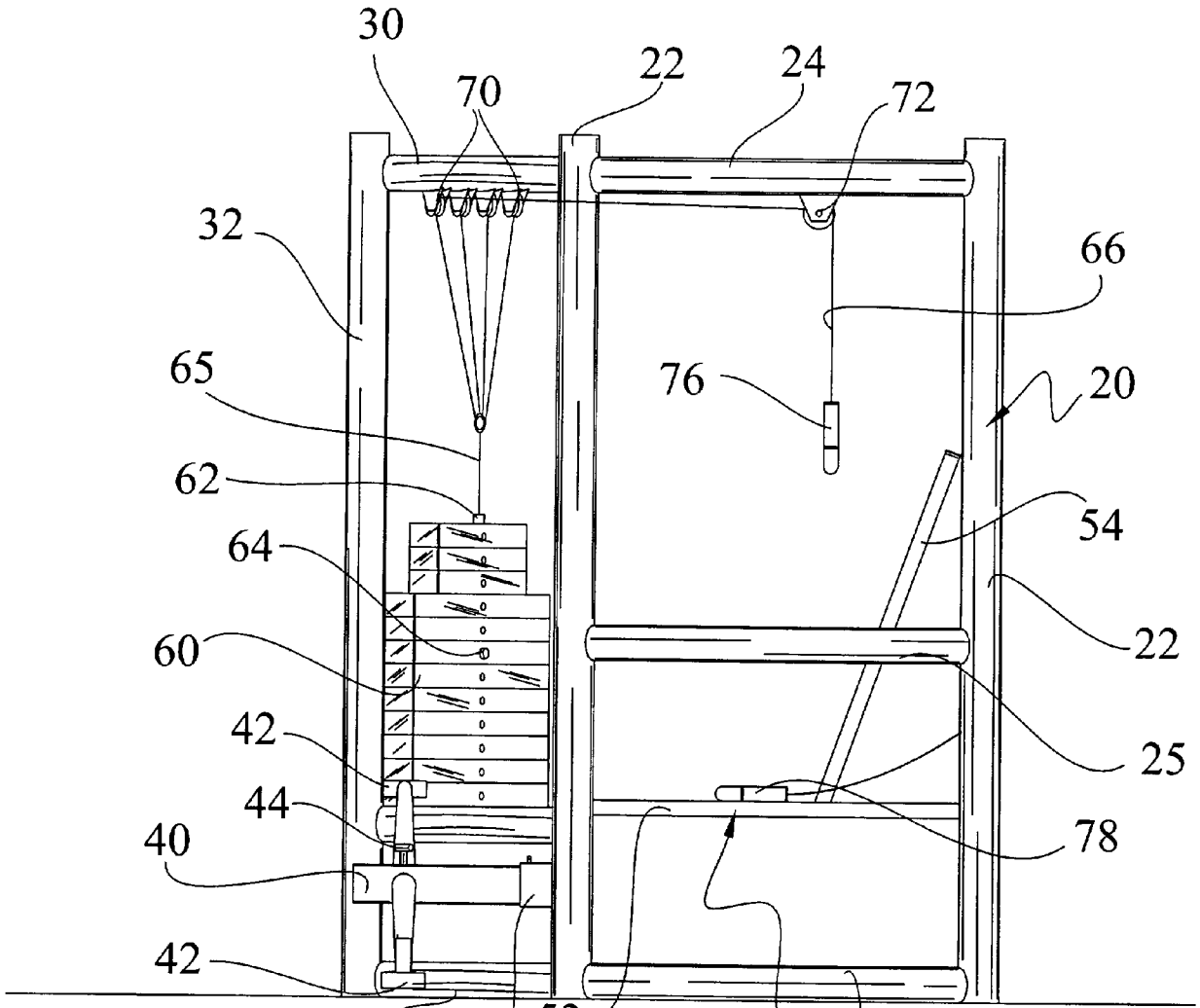
FIG. 3 is a side view of the present invention.

FIGS. 1 through 4 illustrate a seat member 50 attached between the main vertical members 22. The seat member 50 has a lower portion 52 and an upper portion 54 wherein the upper portion 54 preferably extends upwardly at an angle with respect to the lower portion 52. The lower portion 52 preferably is substantially horizontal as best illustrated in FIG. 3 of the drawings. The lower portion 52 may have various shapes capable of receiving and supporting an individual. However, the lower portion 52 preferably has a straight and flat structure capable of receiving individuals of various sizes from 90 pounds to 900 pounds.

The lower portion 52 of the seat member 50 is preferably relatively low with respect to a floor surface such as but not limited to 17–20 inches up from the floor. The relatively low height of the lower portion 52 allows for an individual to easily position themselves within the seat member 50 despite physical limitations or transferring from a wheelchair.

As shown in FIGS. 1 and 2 of the drawings, a pair of opposing arm supports 25 extend between opposing main vertical members 22 for allowing an individual to grasp during entry and exiting of the seat member 50. The arm supports 25 are preferably substantially parallel to the lower portion 52 of the seat member 50. In addition, a gripping and/or cushioning material may be attached to the arm supports 25 for providing increased gripping thereof.

As shown in FIG. 2 of the drawings, a support member 27 having a tubular structure is attached to a front second cross member 26. The front second cross member 26 has an opening within corresponding to the support member 27 for allowing the tongue member 40 to extend through thereof. The support member 27 extends forwardly and centrally with respect to the lower portion 52 of the seat member 50.

The support member 27 has an aperture within the upper side for receiving a support pin 29 for securing an elongate tongue member 40. The tongue member 40 preferably has a plurality of tongue apertures 46 that allow for selective positioning of the tongue member 40 within the support member 27 by inserting the support pin 29 within. The distal portion of the tongue member 40 includes a pair of pedals 42 rotatably attached thereto upon a common rotating shaft. A resistance member 44 preferably is threadably positioned within the tongue member 40 for resistively engaging the rotating shaft thereby allowing the user to adjust the rotating resistance to the pair of pedals 42.

As shown in FIGS. 1 through 3 of the drawings, a weight support frame extends from the frame structure 20 from a side main vertical member 22. The weight support frame is basically comprised of an upper cross member 30 extending from the main vertical member 22, an outer vertical member 32 extending downwardly from the upper cross member 30, and one or more lower cross members 34 extending from the lower end of the outer vertical member 32 to the main vertical member 22. As shown in FIGS. 2 and 4 of the drawings, the upper cross member 30 and the lower cross members 34 are preferably comprised of a curved structure that is angled inwardly for providing easier access to the weight members 60 while the user is seated within the seat member 50.

As shown in FIGS. 1 through 3 of the drawings, a plurality of weight members 60 are movably positioned within the weight support frame similar to conventional weights found in conventional exercise machines. A weight shaft 62 is movably positioned within an aperture within the weight members 60 that is engaged by a weight pin 64 which is commonly utilized within the exercise machine industry.

FIGS. 1 through 3 further illustrate a first cable 66, a second cable 67, a third cable 68 and a fourth cable 69 attached to the upper end of the weight shaft 62. The cables 66, 67, 68, 69 extend upwardly from the weight shaft 62 to a corresponding plurality of first pulleys 70 attached to the upper cross member 30. The cables 66, 67, 68, 69 then extend to corresponding second pulleys 72 attached to upper second cross members 26 as shown in FIGS. 1 and 2 of the drawings.

The first cable 66 and the third cable 68 then extend from the second pulleys 72 downwardly with a pair of first handles 76 attached thereto. The first cable 66 and the third cable 68 are preferably aligned to extend downwardly toward a center portion of the seat member 50.

The second cable 67 and the fourth cable 69 then extend from the second pulleys 72 downwardly to a pair of corresponding third pulleys 74 attached to a middle second cross member 26. The second cable 67 and the fourth cable 69 thereafter extend forwardly and are aligned to allow for the user to perform forward chest exercises and the like by grasping a pair of second handles 78 attached to the second cable 67 and the fourth cable 69.

In use, the user is positioned upon the seat member 50. The user may adjust the weight members 60 before or after being seated upon the seat member 50. The user then may choose a desired resistance exercise. For example, the user may utilize the pedals 42 to simulate a bicycle motion while allowing for adjustment of the resistance using the resistance member 44. The user may also grasp the first handles 76 or the second handles 78 for performing various upper body exercises. When the user manipulates either the first handles 76 or the second handles 78, the selected weight members 60 are elevated and lowered in the appropriate manner as the individual proceeds with their repetitions. When the user is finished, they exit the seat member 50 by grasping the arm supports 25 and moving from the seat member 50 to either a standing position or to a wheelchair.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A resistive exercise system, comprising:

a frame structure;

a seat member attached within said frame structure wherein said seat member is comprised of:

a lower portion attached between a plurality of main vertical members of said frame structure and positioned between 17 to 20 inches above a floor surface; and an upper portion extending upwardly from said lower portion;

a weight support frame attached to a front of said frame structure, wherein said weight support frame is comprised of:

an upper cross member curved inwardly;

an outer member extending downwardly from said upper cross member; and a lower cross member extending from a lower end of said outer vertical member, wherein said lower cross member is curved inwardly;

a plurality of weight members positioned within said weight support frame;

a weight shaft extendable within an aperture within said plurality of weight members secured by a weight pin;

a plurality of cables attached to said weight shaft, wherein said plurality of cables is comprised of a first cable, a second cable, a third cable and a fourth cable;

a plurality of handles attached to said plurality of cables, wherein said plurality of handles are comprised of a pair of first handles attached to said first cable and said third cable and a pair of second handles extendible in both a horizontal and vertical manner attached to said second cable and said fourth cable; and a plurality of pulleys attached to said weight support frame and said frame structure for supporting said plurality of cables.

2. The resistive exercise system of claim 1, including a support member having a tubular structure attached to said front of said frame structure centrally aligned with said seat member, a tongue member movably positioned within said support member having a plurality of tongue apertures, a support pin positionable within said support member and a selected tongue aperture, a pair of pedals rotatably attached to a distal portion of said tongue member by a rotating shaft, and a resistance member threadably positioned within said tongue member for frictionally engaging said rotating shaft.

* * * * *